US009958167B2

(12) United States Patent
Lomicka et al.

(10) Patent No.: US 9,958,167 B2
(45) Date of Patent: May 1, 2018

(54) ELECTROMECHANICAL ASSEMBLY FOR APPLIANCE DOOR LATCHING

(71) Applicant: HTI Technology and Industries, Inc., Lavergne, TN (US)

(72) Inventors: Joseph W. Lomicka, Lexington, TN (US); I-Chiang Lin, San Marino, CA (US); Roger L. DeYoung, Franklin, TN (US); Marshall E. Aurnou, Marco Island, FL (US); Michael A. Rosenstock, Nashville, TN (US)

( * ) Notice: Subject to any disclaimer, the term of this patent is extended or adjusted under 35 U.S.C. 154(b) by 0 days. days.

(21) Appl. No.: 15/149,042

(22) Filed: May 6, 2016

(65) Prior Publication Data

US 2016/0290657 A1 Oct. 6, 2016

Related U.S. Application Data

(63) Continuation-in-part of application No. 14/173,704, filed on Feb. 5, 2014, now Pat. No. 9,335,056.

(51) Int. Cl.

| | |
|---|---|
| ***E05C 3/06*** | (2006.01) |
| ***F24C 15/02*** | (2006.01) |
| ***E05B 47/00*** | (2006.01) |
| ***E05B 47/02*** | (2006.01) |
| ***E05B 53/00*** | (2006.01) |
| *E05C 3/16* | (2006.01) |
| *E05B 63/00* | (2006.01) |

(52) U.S. Cl.

CPC ..... *F24C 15/022* (2013.01); *E05B 47/0012* (2013.01); *E05B 47/023* (2013.01); *E05B 53/00* (2013.01); *E05B 63/0013* (2013.01); *E05B 2047/0024* (2013.01); *E05B 2047/0051* (2013.01); *E05B 2047/0068* (2013.01); *E05Y 2900/308* (2013.01); *Y10S 292/69* (2013.01)

(58) Field of Classification Search

CPC ..... Y10S 292/69
USPC ..... 292/201
See application file for complete search history.

(56) References Cited

U.S. PATENT DOCUMENTS

| | | | | |
|---|---|---|---|---|
| 3,462,584 A | | 8/1969 | Guy | |
| 4,593,945 A | * | 6/1986 | Arute | F24C 15/022 292/201 |
| 4,691,195 A | * | 9/1987 | Sigelman | F25D 29/008 200/61.62 |

(Continued)

OTHER PUBLICATIONS

International Search Report and Written Opinion dated Aug. 4, 2017 for corresponding PCT Application No. PCT/US2017/031013 filed on May 4, 2017.

*Primary Examiner* — Carlos Lugo
(74) *Attorney, Agent, or Firm* — Roger D. Emerson; Emerson Thomson & Bennett, LLC

(57) ABSTRACT

A latching assembly uses a flat sheet metal chassis with electrical switches, an electrical motor driving a cam, a push rod, a hook, a spring, and various actuators/levers. When a first actuator/lever is moved by an outside force, a circuit connection may be opened or closed depending upon the configuration of the electro-mechanical system. This will generate a signal which will allow current to flow to a motor. The motor will, in turn, drive the cam which will push a second actuator/lever to move and cause a hook to move from a first, non-latching position to a second, latching position. The assembly is useful for latching an oven or other appliance door when operating at high temperature.

12 Claims, 13 Drawing Sheets

(56) References Cited

U.S. PATENT DOCUMENTS 4,927,996 A 5/1990 Genbauffe et al.
5,220,153 A * 6/1993 Malone ..... F24C 15/022 126/197
5,516,164 A * 5/1996 Kobayashi ..... E05B 81/20 292/201
5,746,076 A * 5/1998 Inoue ..... E05B 81/06 292/201
5,938,252 A * 8/1999 Uemura ..... E05B 81/14 292/201
6,302,098 B1 10/2001 Smith
6,315,336 B1 11/2001 Swartzell
6,601,882 B1 * 8/2003 Cole ..... E05B 47/0012 200/61.64
6,659,515 B2 * 12/2003 Raymond ..... E05B 81/20 292/201
6,698,418 B2 3/2004 Ramsey et al.
6,709,029 B2 * 3/2004 Cole ..... E05B 17/0029 126/197
6,863,316 B2 3/2005 Cole
7,010,947 B2 * 3/2006 Milo ..... E05B 47/0012 292/144
7,036,853 B2 * 5/2006 Smock ..... E05B 17/0029 292/109
7,040,674 B2 5/2006 Lomicka et al.
7,066,503 B2 * 6/2006 Smith ..... F24C 15/022 126/197
7,137,387 B2 11/2006 Edwards
7,156,428 B2 * 1/2007 Smith ..... E05B 17/0029 292/109
7,185,925 B2 3/2007 Courter et al.
7,334,823 B2 * 2/2008 Courter ..... E05B 17/0029 126/197
7,726,294 B2 6/2010 Collene et al.
8,919,828 B2 * 12/2014 Barth ..... E05B 85/243 292/201
2003/0080569 A1 5/2003 Raymond et al.
2003/0116975 A1 6/2003 Cole
2004/0140677 A1 * 7/2004 Hengelein ..... D06F 37/42 292/201
2005/0077737 A1 * 4/2005 Komiyama ..... E05B 81/78 292/336.3
2005/0284464 A1 12/2005 Edwards et al.
2006/0237974 A1 * 10/2006 Hamm ..... B60R 21/13 292/216
2008/0030028 A1 2/2008 Heid et al.
2009/0202286 A1 * 8/2009 Hirabayashi ..... B41J 15/042 400/663
2015/0330112 A1 * 11/2015 Van Wiemeersch .... E05B 81/76 292/201

* cited by examiner

ELECTROMECHANICAL ASSEMBLY FOR APPLIANCE DOOR LATCHING

TECHNICAL FIELD

Provided is an electromechanical latching apparatus for an appliance. Also provided is a corresponding method for assembling an electromechanical latching apparatus within an appliance.

BACKGROUND

Cooking ovens are often equipped with a self-cleaning feature in which the oven is heated to high temperatures in order to burn-off organic material within the oven. At the end of the self-cleaning cycle, ashes are easily removed from the oven. For safety purposes, it is important to keep the oven door closed during the self-cleaning cycle. Consequently, ovens with self-cleaning features are equipped with mechanical or electro-mechanical latches. Other appliances that may use electro-mechanical latches include cooking stoves and ranges. These latches typically use sensor switches that detect the latch position and the oven door position. The resulting detections interface with a controller within the control panel.

Electro-mechanical latches are typically powered by an electric synchronous gear motor which actuates the latch linkage and rotates a cam that actuates one or more sensor switches. The oven door activates another sensor switch by means of a secondary cam or simple linkage. The motor and switches each have a minimum of two terminals; thus each latch has a minimum of four and a maximum of ten wire connection terminals. The most common latches have six wire connection terminals.

Oven and other cooking appliance manufacturers must connect the controller wires to the appropriate terminals on the latch. Failure to connect the wires correctly can cause unsafe operating conditions. The opportunity for connection error is a significant problem for oven manufacturers. Further, the labor for connecting wires to many connection points is costly.

Conventional issues that arise with the electromechanical assemblies now in use on cooking stove, ranges and ovens include difficulty in connecting multiple wire-harness connectors to their respective socket ports on the assembly, waste of assembly time in the latter activity, electromagnetic interference from motors on or near the assembly causing false signals and complexity and time requirements of point-to-point wiring. The present disclosure provides an electromechanical assembly for oven door and other cooking appliance latching that solves known issues of current oven and other cooking appliance latches. In particular, the present disclosure provides improvements to interlocking assemblies, improvements that overcome problems with respect to saving assembly time, reducing assembly errors and improving operational performance as well as other benefits.

SUMMARY

Figure 1:
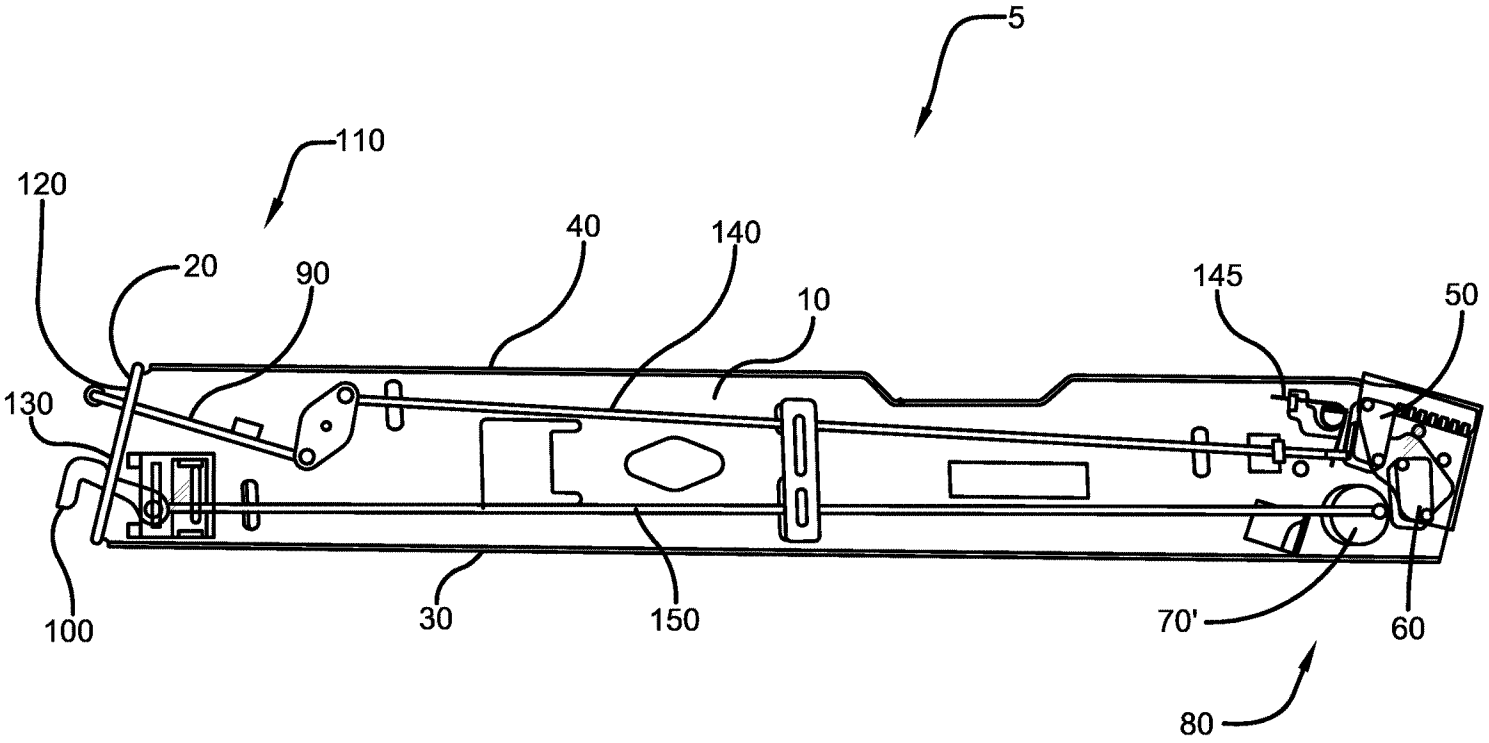
FIG. 1 is a front perspective view of an exemplary embodiment of the presently described apparatus.

Provided is a latching apparatus having a proximal end and a distal end and movable between a non-latching state and a latching state. The latching apparatus is suitable for use with an appliance having a door and includes a chassis which houses at least one electrical switch, an electrical motor driving a cam, a door switch actuator having a proximal end and a distal end, a latch hook, and a flexible printed circuit. When the latching apparatus is in the non-latching state, the proximal end of the door switch actuator is in an first position with respect to the electrical switch and the distal end of the door switch actuator is in a corresponding first position; the position of the proximal end of the door switch actuator with respect to the electrical switch results in an open or closed electrical circuit with the electrical switch; and the latch hook is in a non-latching position wherein the proximal end of the latch hook is engaged with the cam, the cam being in contact with but not activated by the switch. When the latching apparatus is in the latching state, the proximal end of the door switch actuator is in a second position with respect to the electrical switch and the distal end of the door switch actuator is in a corresponding second position; the door of the apparatus will engage the door switch actuator, so as to move the door switch actuator into the second position, wherein movement of the door switch actuator causes the proximal end of the door switch actuator to contact or not contact the electrical switch to close a circuit between the switch and the motor; and the latch hook is in a latching position wherein the proximal end of the latch hook, engaged with the cam, is activated by the electrical switch and the motor, wherein the motor is activated by the closed circuit between electrical switch and the motor and wherein the activated motor causes the cam and the latch hook to move to the latching position. The electrical switch and the electrical motor are electrically connected to each other through a flexible printed circuit which connects the electrical switch to a single point power connector comprising a connector port and electrical connector pins, wherein the connector port and electrical connector pins receive a plug on a wire harness which provides electrical power to the motor.

In certain embodiments, the electrical connector pins of the connector port may extend into and penetrate through the flexible printed circuit.

In further embodiments, the single power point connector is integrated into the motor.

In further embodiments, the latching apparatus includes three or more electrical switches.

In further embodiments, at least one electrical switch receives a signal from a control panel indicating that a user has provided an instruction to engage the latch hook when the door is closed. Specifically, a user enters an input (e.g., selects a self-clean function) within the control panel. The controller within the appliance engages the latching or locking mechanism. When the latching mechanism fully latches the door, a switch returns a signal to the controller allowing the self-clean function to initiate.

In further embodiments, the electrical circuit between the switches and the motor is completed upon closing of the door.

In further embodiments, the motor is a synchronous motor and the cam is a switch actuation eccentric cam.

In further embodiments, a lever connects the switch actuation eccentric cam to a pivotal axle on the latch hook.

In further embodiments, the distal end of the latch hook engages a slot so that as the switch actuation eccentric cam rotates, the latch hook may both move along the slot between a latching position and a non-latching position.

In further embodiments, a first biasing device engages the door switch actuator to a first latching portion on the chassis.

In further embodiments, a second biasing device engages the latch hook to a second latching portion on the chassis.

Also provided is a latching apparatus having a proximal end and a distal end and movable between a non-latching state and a latching state. The latching apparatus is suitable for use with an appliance having a door and includes a chassis which houses a first electrical switch, a second electrical switch, an electrical motor driving a cam, a flexible printed circuit, a push rod having a proximal end and a distal end, a hook, a spring, and a first actuator rod and a second actuator rod having a proximal end and a distal end. When the latching apparatus is in the non-latching state, the first actuator rod is in a proximal position wherein the proximal end of the first actuator rod is engaged with the spring, the spring being in a relaxed state, thereby making contact with the first electrical switch to form a closed electrical circuit with the first electrical switch, and the distal end of the first actuator rod is engaged with the proximal end of the push rod by a pivoting link member, the push rod being in a distal position; and the second actuator rod is in a proximal position wherein the proximal end of the second actuator rod is engaged with the cam, the cam being in contact with but not activated by the second switch, and the distal end of the second actuator rod is engaged with the hook, the hook being in a non-latching state. When the latching apparatus is in the latching state, the first actuator rod is in a distal position wherein the door of the appliance will engage the push rod, so as to move the push rod toward a proximal position and wherein movement of the push rod actuates the first actuator rod to move to a distal position causing the proximal end of the first actuator rod, engaged with the spring, to break contact with the first electrical switch to form an electrical open and the distal end of the first actuator rod is engaged with the proximal end of the push rod by a pivoting link member in a manner which allows the push rod to be in a proximal position; and the second actuator rod is in a distal position wherein the proximal end of the second actuator rod, engaged with the cam, is in contact with and is activated by the second switch to axially translate the second actuator rod to the distal position, and the distal end of the second actuator rod, engaged with the hook, moves the hook to a latching position, wherein when the pushrod is moved towards the proximal end of the latching apparatus, the first electrical circuit formed by the first switch is broken, thereby forming a second electrical circuit with the second switch which energizes and causes rotation of the electric motor which causes the cam to rotate to cause a latching action by the hook; wherein the electrical switches and the electrical motor are electrically connected to each other through a flexible printed circuit which connects the electrical switches to a single point power connector comprising a connector port and electrical connector pins, wherein the connector port and electrical connector pins receive a plug on a wire harness which provides electrical power to the motor.

In certain embodiments, the electrical connector pins of the connector port extend into and penetrate through the flexible printed circuit.

In further embodiments, the single power point connector is integrated into the motor.

In further embodiments, the latching apparatus includes three or more electrical switches.

In further embodiments, at least one electrical switch receives a signal from a control panel indicating that a user has provided an instruction to engage the latch hook when the door is closed. Such an instruction may be provided by the user engaging a self-clean function within a control panel and a controller subsequently activating the latching apparatus.

In further embodiments, the electrical circuit between the second and third electrical switches and the motor is completed upon closing of the door.

In further embodiments, the motor is a synchronous motor and the cam is a switch actuation eccentric cam.

Also provided is a method of assembling a latching apparatus within an appliance. The method includes the following steps: providing an appliance comprising a door and a door latch; providing a latching apparatus comprising a chassis housing a first electrical switch, a second electrical switch, an electrical motor driving a cam, a flexible printed circuit, a push rod having a proximal end and a distal end, a hook, a spring, and a first actuator rod and a second actuator rod having a proximal end and a distal end within a chassis, wherein the latching apparatus operates in the following manner: wherein when the latching apparatus is in the non-latching state: the first actuator rod is in a proximal position wherein: the proximal end of the first actuator rod is engaged with the spring, the spring being in a relaxed state, thereby making contact with the first electrical switch to form a first closed electrical circuit with the first electrical switch, and the distal end of the first actuator rod is engaged with the proximal end of the push rod, the push rod being in a distal position; and the second actuator rod is in a proximal position wherein: the proximal end of the second actuator rod is engaged with the cam, the cam being in contact with but not activated by the second switch, and the distal end of the second actuator rod is engaged with the hook, the hook being in a non-latching state; and wherein when the latching apparatus is in the latching state: the first actuator rod is in a distal position wherein: the proximal end of the first actuator rod, engaged with the spring, is actuated by breaking contact with the first electrical switch to form an electrical open and the distal end of the first actuator rod is engaged with the proximal end of the push rod in a manner which allows the push rod to be in a proximal position; and the second actuator rod is in a distal position wherein: the proximal end of the second actuator rod, engaged with the cam, is in contact with and is activated by the second switch to axially translate the second actuator rod to the distal position, and the distal end of the second actuator rod, engaged with the hook, moves the hook to a latching position, wherein when the pushrod is moved towards the proximal end of the latching apparatus, the first electrical circuit formed by the first switch is broken, thereby forming a second electrical circuit with the second switch which energizes and causes rotation of the electric motor which causes the cam to rotate to cause a latching action by the hook wherein the electrical switches and the electrical motor are electrically connected to each other through a flexible printed circuit which connects the electrical switches to a single power point connector comprising a connector port and connector pins which receive a plug on a wire harness and wherein the electrical connector pins of the connector port extend into and penetrate through the flexible printed circuit; inserting the chassis containing the component parts of the latching assembly within the appliance; orienting the chassis and latching assembly within the appliance in a manner which allows the hook to engage the door; mechanically connecting the latching assembly to the appliance by connecting the chassis to the appliance; and electrically connecting the latching assembly to the appliance by connecting the plug to the connector port through the single point power connection.

Also provided is a method of assembling a latching apparatus within an appliance. The method includes the following steps: providing an appliance comprising a door and a door latch; providing a latching apparatus comprising a chassis which houses at least one electrical switch, an electrical motor driving a cam, a door switch actuator having a proximal end and a distal end, a latch hook, and a flexible printed circuit; wherein when the latching apparatus is in the non-latching state: the proximal end of the door switch actuator is in a first position with respect to the electrical switch and the distal end of the door switch actuator is in a corresponding first position, wherein the position of the proximal end of the door switch actuator with respect to the electrical switch, results in an open or closed electrical circuit with the electrical switch, and the latch hook is in a non-latching position wherein the proximal end of the latch hook is engaged with the cam, the cam being in contact with but not activated by the switch, and wherein when the latching apparatus is in the latching state: the proximal end of the door switch actuator is in a second position with respect to the electrical switch and the distal end of the door switch actuator is in a corresponding second position wherein: the door of the apparatus will engage the door switch actuator, so as to move the door switch actuator into the second position, wherein movement of the door switch actuator into the second position causes the proximal end of the door switch actuator to contact or not contact the electrical switch to close a circuit between the switch and the motor and the latch hook is in a latching position wherein the proximal end of the latch hook, engaged with the cam, is activated by the electrical switch and the motor, wherein the motor is activated by the closed circuit between electrical switch and the motor and wherein the activated motor causes the cam and the latch hook to move to the latching position, and wherein the electrical switch and the electrical motor are electrically connected to each other through a flexible printed circuit which connects the electrical switch to a single point power connector comprising a connector port and electrical connector pins, wherein the connector port and electrical connector pins receive a plug on a wire harness which provides electrical power to the motor, wherein the electrical connector pins of the connector port extend into and penetrate through the flexible printed circuit. inserting the chassis containing the component parts of the latching assembly within the appliance; orienting the chassis and latching assembly within the appliance in a manner which allows the hook to engage the door latch; mechanically connecting the latching assembly to the appliance by connecting the chassis to the appliance; and electrically connecting the latching assembly to the appliance by connecting the plug to the connector port through the single point power connection.

DETAILED DESCRIPTION

Provided is an electromechanical assembly that incorporates a flexible printed circuit. In certain embodiments, the flexible printed circuit connects all sensor switch terminals and motor terminals. In further embodiments, a single power point connection is built into a motor terminal body.

The presently described oven door latching assembly 5 is mounted as a part of an appliance (not shown) such as a cooking stove or oven. It is positioned within the appliance in a position where it is able to safely lock an oven door during high temperature operations such as oven cleaning.

In a first exemplary embodiment referred to as a long bar oven latch, shown in FIG. 1, assembly 5 may be constructed with a rectangular sheet metal chassis 10 which may be an elongated, generally flat part which may have flanges 20, 30, 40 on three sides providing rigidity, structural support and other benefits. FIG. 1 shows a front face of chassis 10. Electrical switches and a motor may be fixedly mounted at a proximal end 80 of chassis 10 and a push rod and a hook may be movably mounted at an opposing distal end 110.

Figure 2:
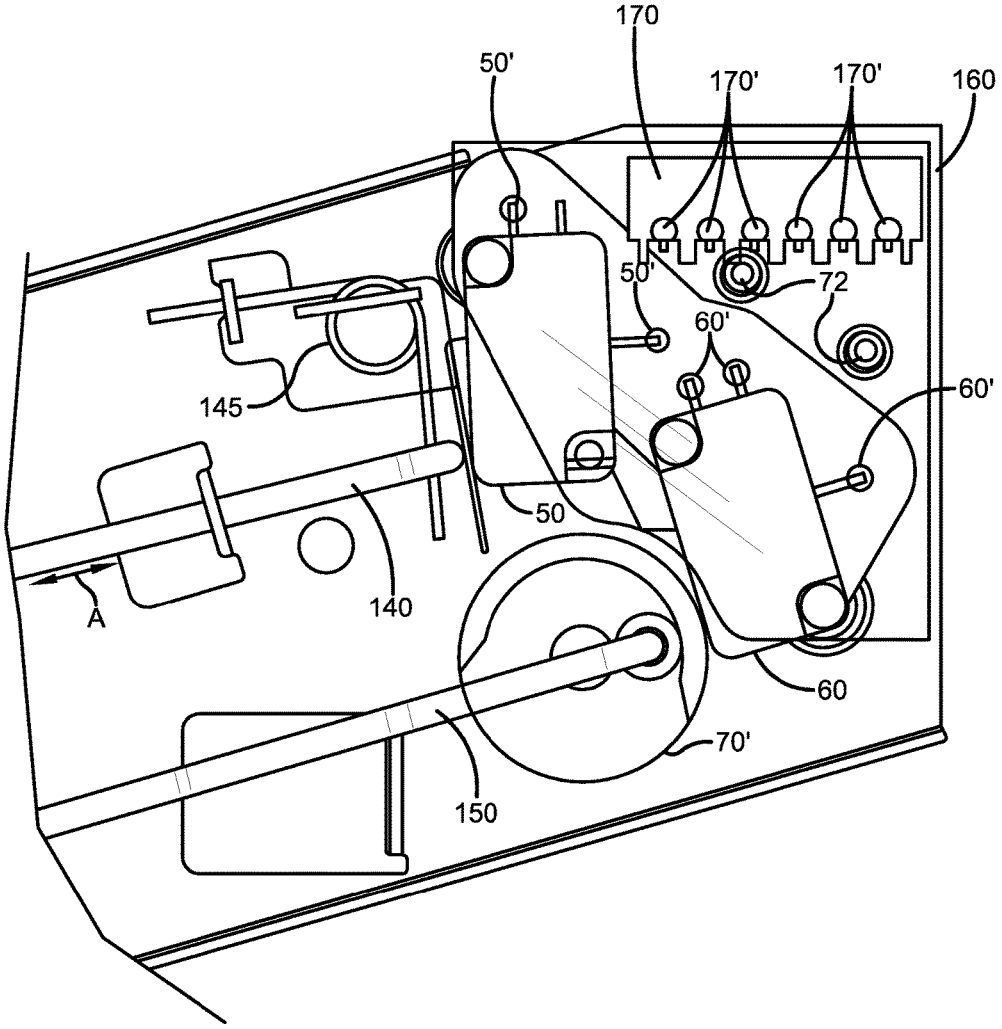
FIG. 2 is a view of a proximal portion of FIG. 1.
Figure 3:
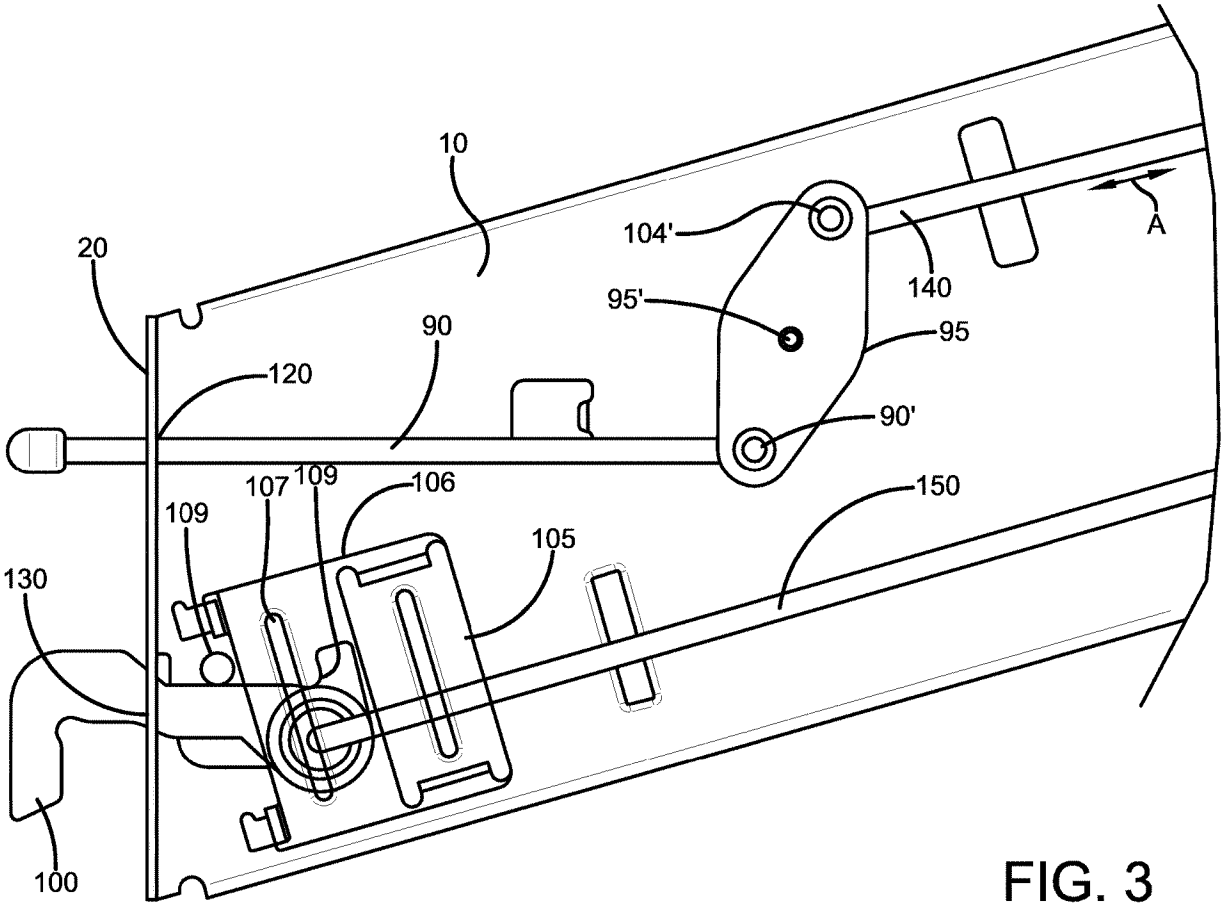
FIG. 3 is a view of a proximal portion of a distal portion of FIG. 1.

As shown in FIG. 2, electrical switches 50 and 60 and an electrical motor 70 (FIG. 4) may be fixedly mounted to chassis 10 at the proximal end 80. A push rod 90 and a hook 100 may be movably mounted at the distal end 110 and both push rod 90 and hook 100 may extend outwardly from the distal end 110 through penetrations 120 and 130 in flange 20 as shown in FIG. 3. Actuator rods 140 and 150 may be secured on chassis 10 in a manner that enables them to move axially. The actuator rod 140 is secured for axial motion so as to transfer force between push rod 90 and switch 50. The actuator rod 150 is secured for axial motion so as to transfer force between motor 70 and hook 100.

Figure 4:
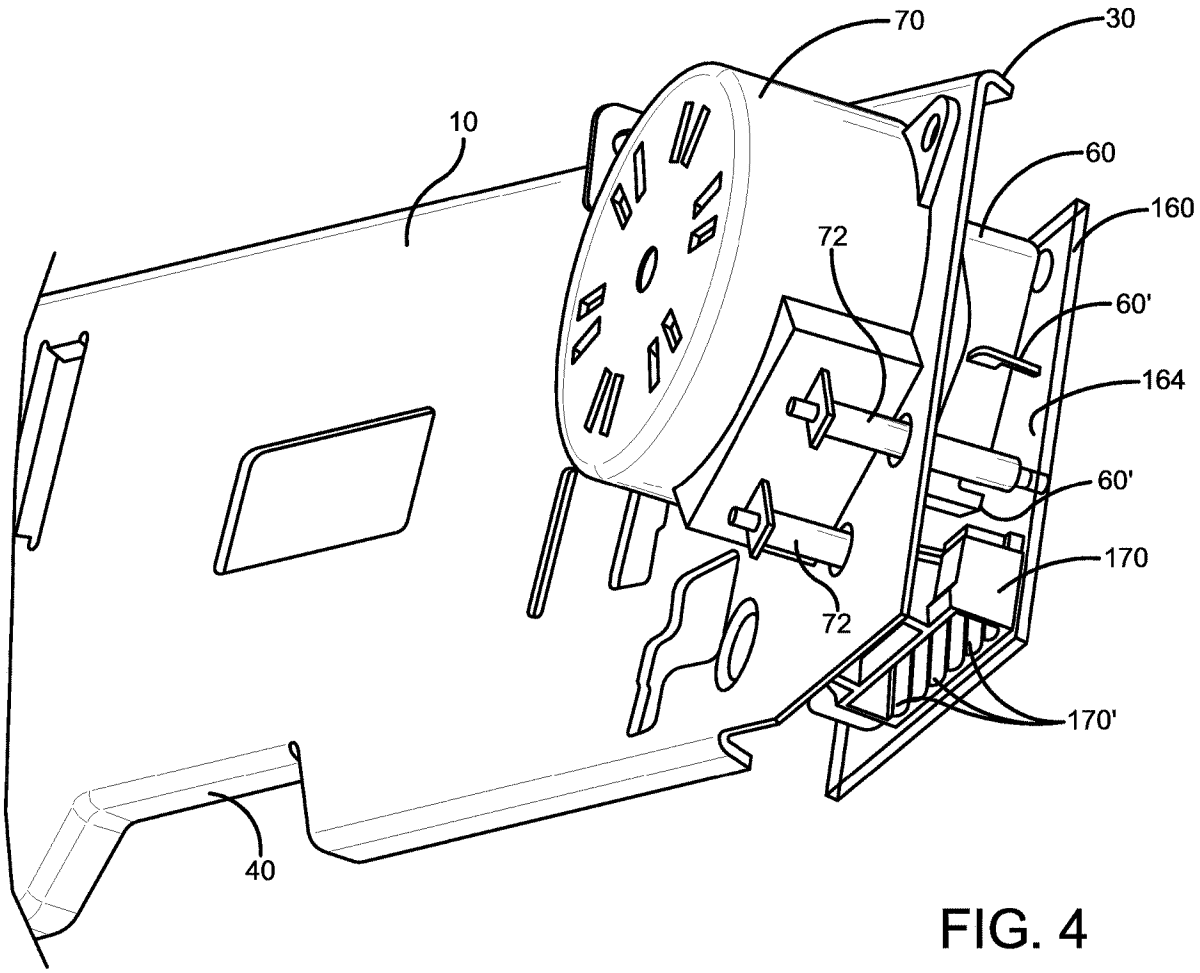
FIG. 4 is a rear perspective view of a proximal portion shown in FIG. 2.
Figure 5:
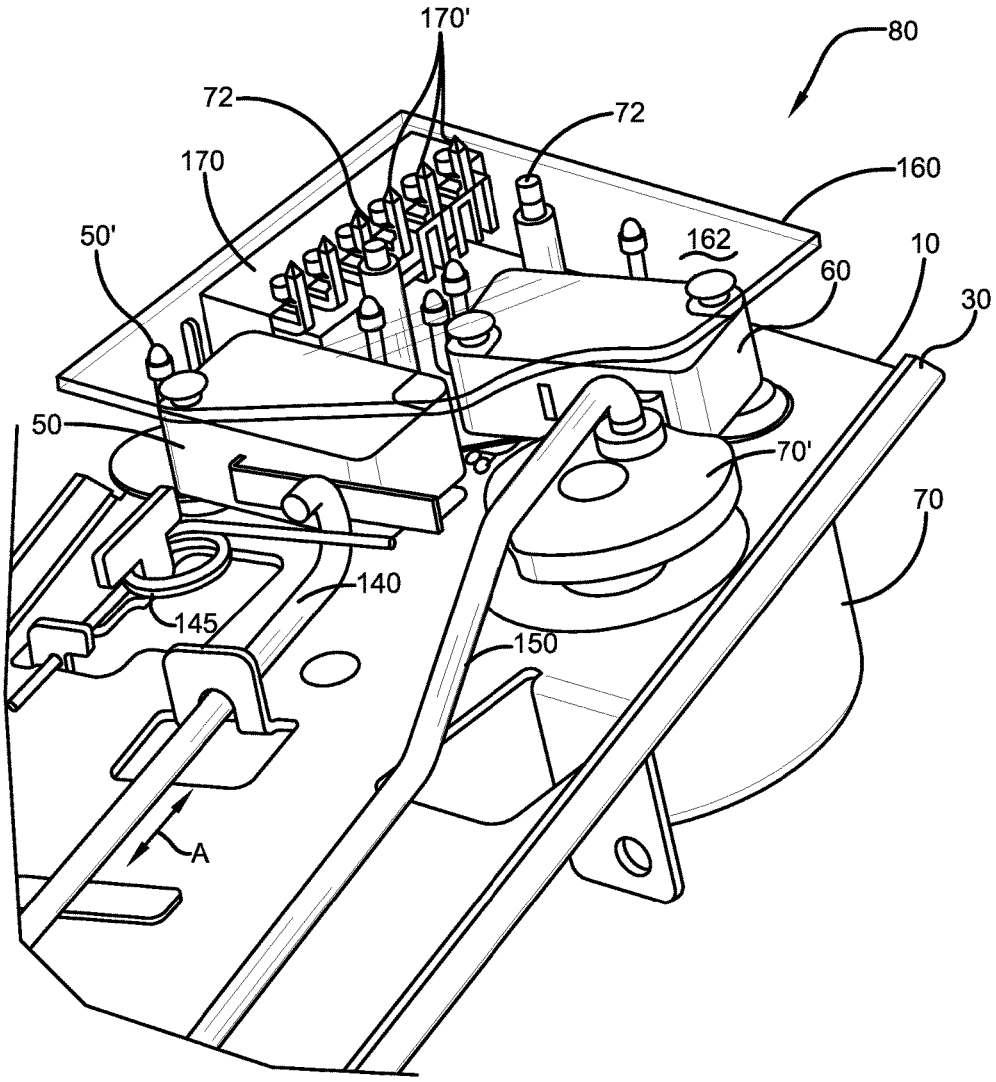
FIG. 5 is a proximal front perspective view of FIG. 2.

FIGS. 4 and 5 show that a printed circuit board 160 is mounted on switch 60 above, and spaced apart from, chassis 10, and a connector port 170 may be mounted on the front face of chassis 10. The electrical connector pins 170' of port 170 may extend into, and penetrate through, board 160 as is shown in FIG. 5. Switches 50 and 60 also may have electrical terminals 50' and 60' respectively, which may extend through board 160. Board 160 may carry passive electrical components such as fuses, capacitors, and resistors (not shown). Such a circuit on surface 162 may be subjected to electromagnetic fields and electrical transients induced by switches 50 and 60, and especially by motor 70. The underside 164 of board 160 may be metal coated so as to form a conductive ground plane and electromagnetic shield which may protect against transient electromagnetic fields produced by the operation of switches 50 and 60, and motor 70.

FIG. 3 shows by arrow "A" that actuator rod 140 is able to translate axially. In FIGS. 2 and 5, it is shown that spring 145 presses rod 140 against a lever of switch 50, whereby rod 140 is in a proximal position. Now, moving distally, in FIG. 3, it is shown that actuator rod 140 pivotally engages push rod 90 through rotational link 95 which may rotate about pivotal axle 95' which may be rotationally fixed to chassis 10. Pivotal axles 90' and 104 may rotationally fasten push rod 90 and actuator rod 140 respectively to link 95.

Therefore, as can be seen that a terminal end of, push rod 90 may be extended distally away from flange 20. Link 95 may function to reverse a directional sense of rod 90 so that when rod 140 moves proximally (to the right in FIG. 3), rod 90 moves distally (to the left in FIG. 3).

FIG. 5 shows that actuator rod 150 may be engaged with eccentric cam 70' which may be rotated by motor 70. With cam 70' in the position shown in FIG. 5, rod 150 is at its proximally terminal location. As shown in FIG. 3, the distal end of rod 150 may engage slot 107 so that as cam 70' rotates, rod 150 and hook 100 both may move along slot 107. Sheet metal bridge 105 may be positioned over rod 150 preventing it from disengaging from slot 107. As the distal end of rod 150 moves along slot 107 hook 100 extends outward from flange 20 until curve 109' engages peg 109 at which time both hook 100 and rod 150 are in their distally extreme positions whereupon hook 100 may engage a door latch (not shown) thereby securing an oven door in its sealed position. As the oven door is closed, it pushes rod 90 in the proximal direction thereby releasing the lever of the switch 50 (electrical open) thereby signaling that the oven door is secured and that it is acceptable to energize motor 70 to cause latching as described above. However, it is understood within the art that the switch logic depends upon the appliance controller. Some controllers use broken (open) circuits to engage a function whereas other controllers may use closed switches to engage a function. Therefore, it should be understood that the present disclosure also encompasses embodiments where the push rod 90 by itself (i.e., without a first actuator rod 140 and a rotational link 95) moves in the proximal direction to directly contact the lever of the switch 50 to close an electrical circuit which signals that the oven door is secured and that it is acceptable to energize the motor 70.

The above-described sequence of events is triggered when the oven door is closed and a console button is depressed to generate an electrical signal for high temperature cleaning. This signal is transmitted through pins 170' of connector port 170 via a plug on a wire harness (not shown) and then through printed circuit conductive paths on circuit board 160 to energize motor 70 through switch 60. Thus, electrical switches 50 and 60 and the electrical motor 70 are electrically connected to each other through the printed circuit board 160 which receives electrical power through a single point power connection. The single point power connection used to transmit electrical power to electrical switches 50 and 60 and the electrical motor 70 is established by connecting a plug to a receptacle within the connector port 170. In certain cases, this embodiment may be referred to as a long bar oven latch with a single power point connector.

Figure 6:
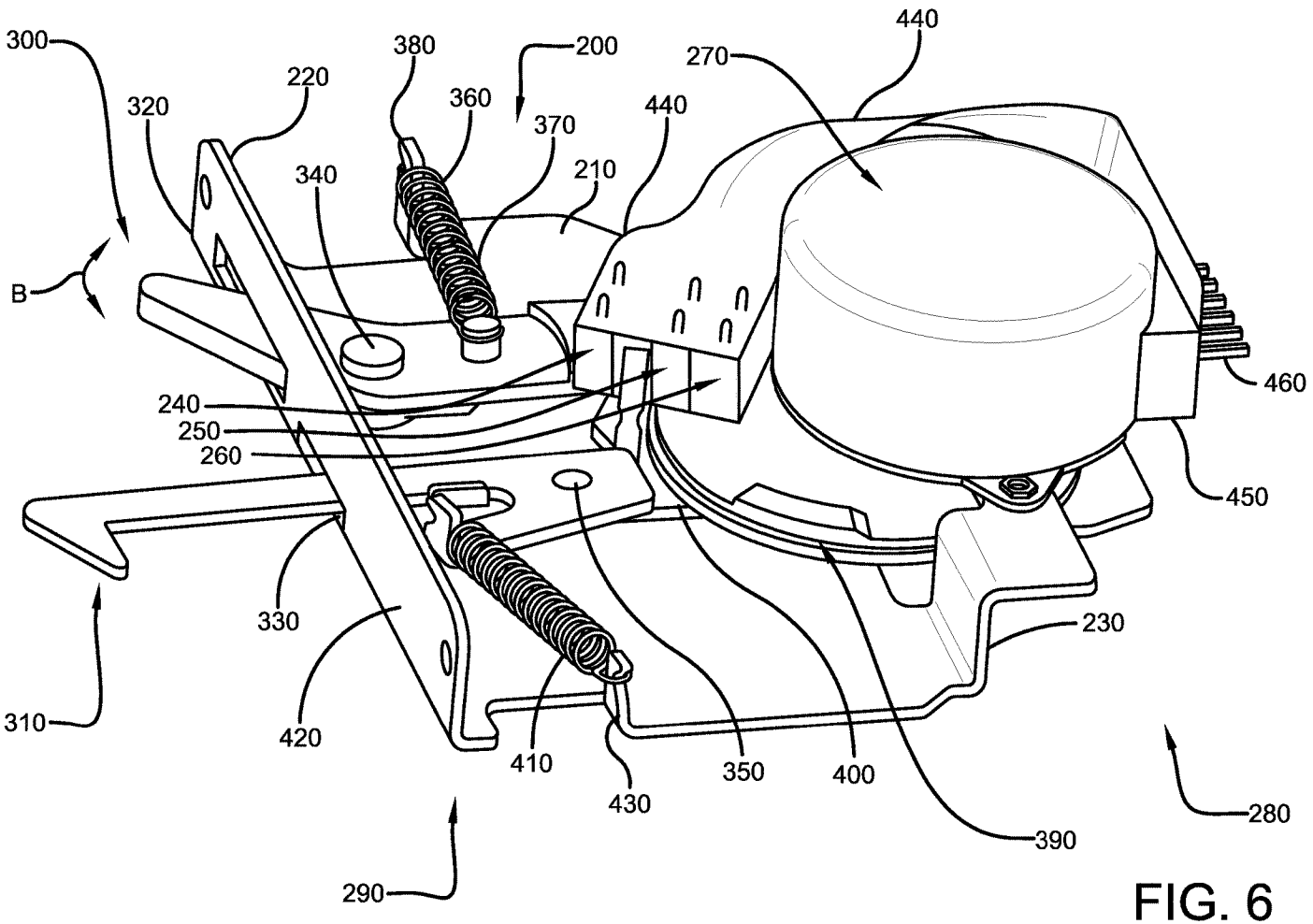
FIG. 6 is front perspective view of an exemplary embodiment of the presently described apparatus.
Figure 7A:
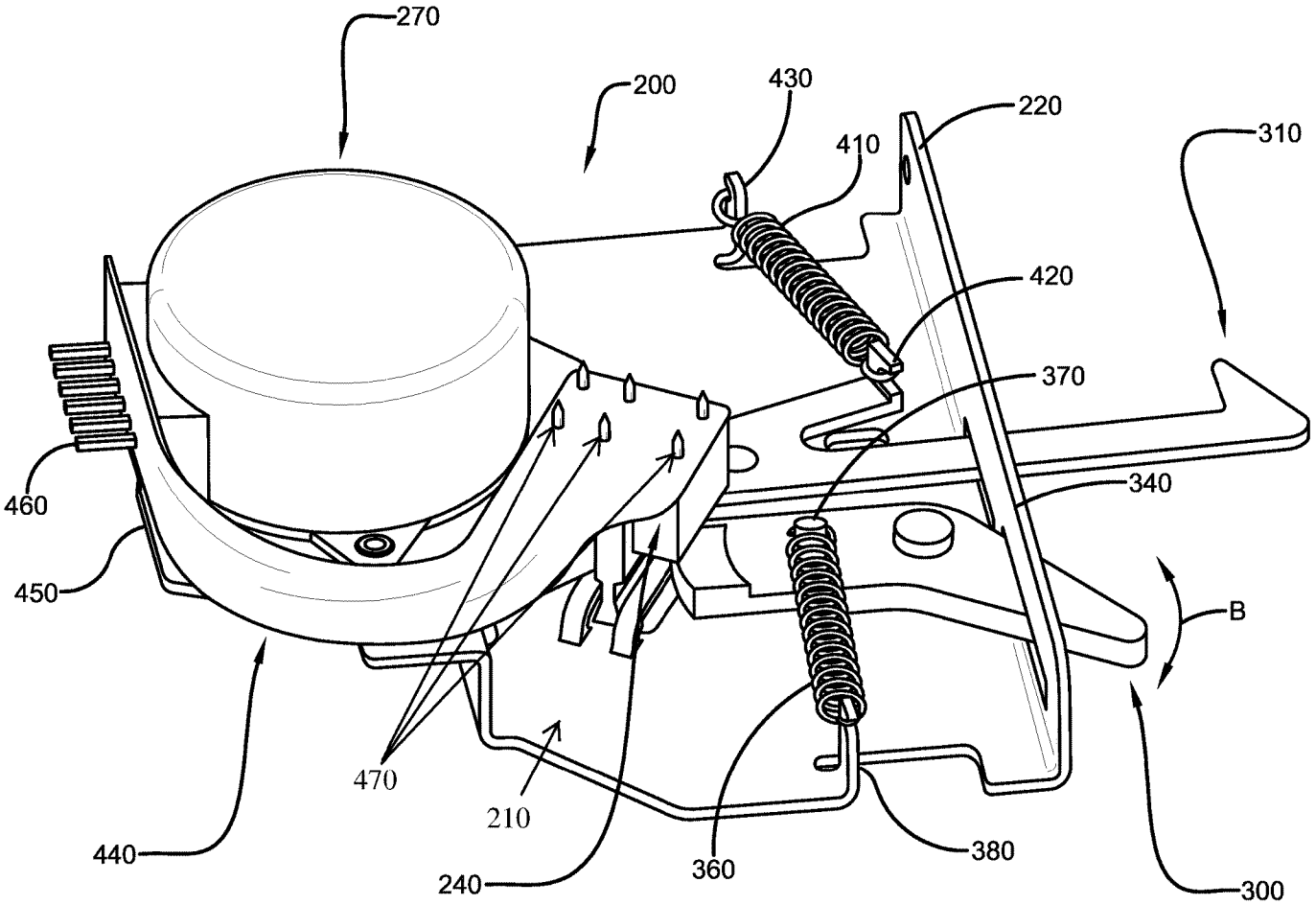
FIGS. 7*a* and 7*b* show an alternative front perspective view of the apparatus shown in FIG. 6.
Figure 7B:
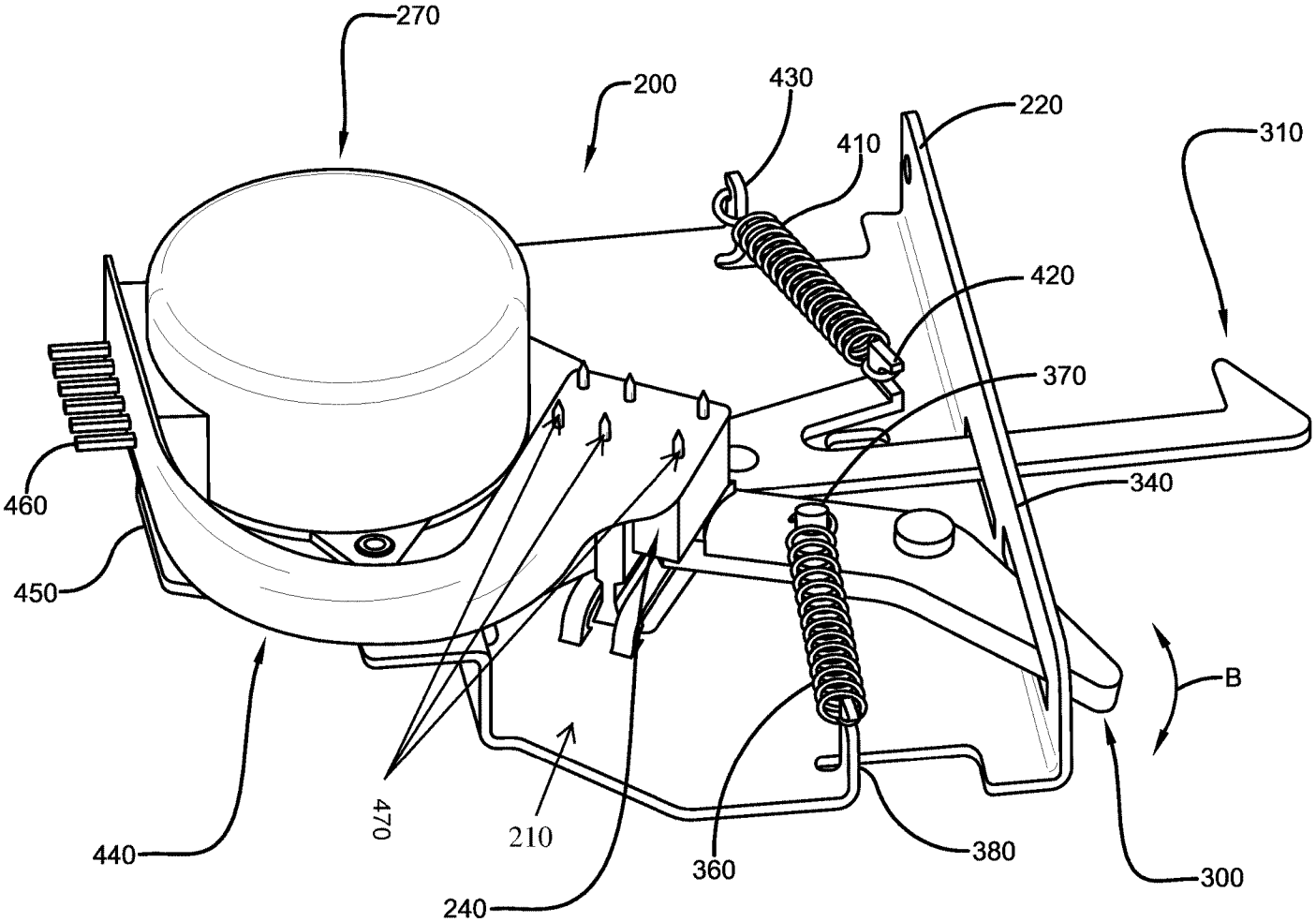
Figure 8:
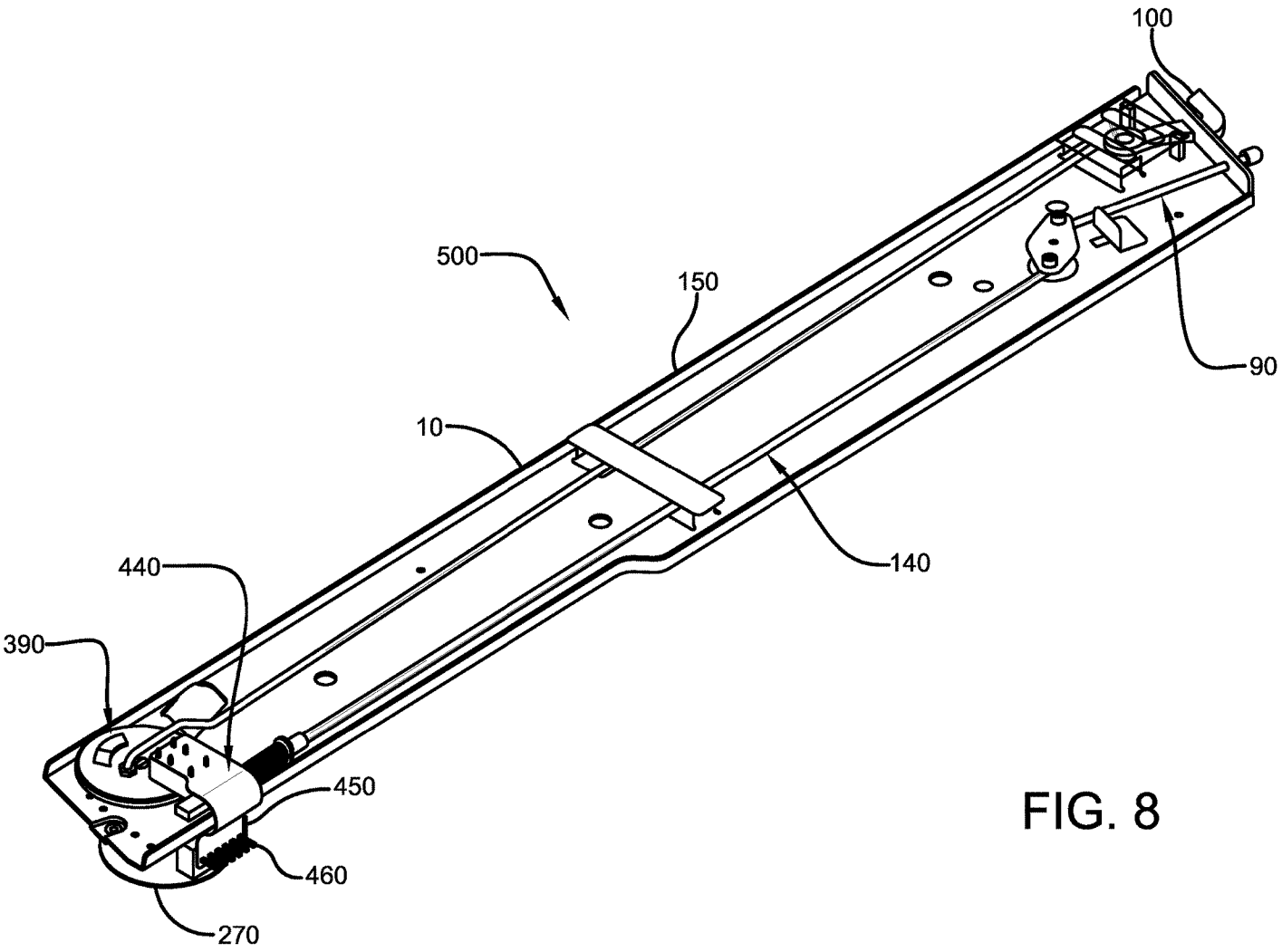
FIG. 8 is a perspective view of the top side of an exemplary embodiment of the presently described apparatus.
Figure 9:
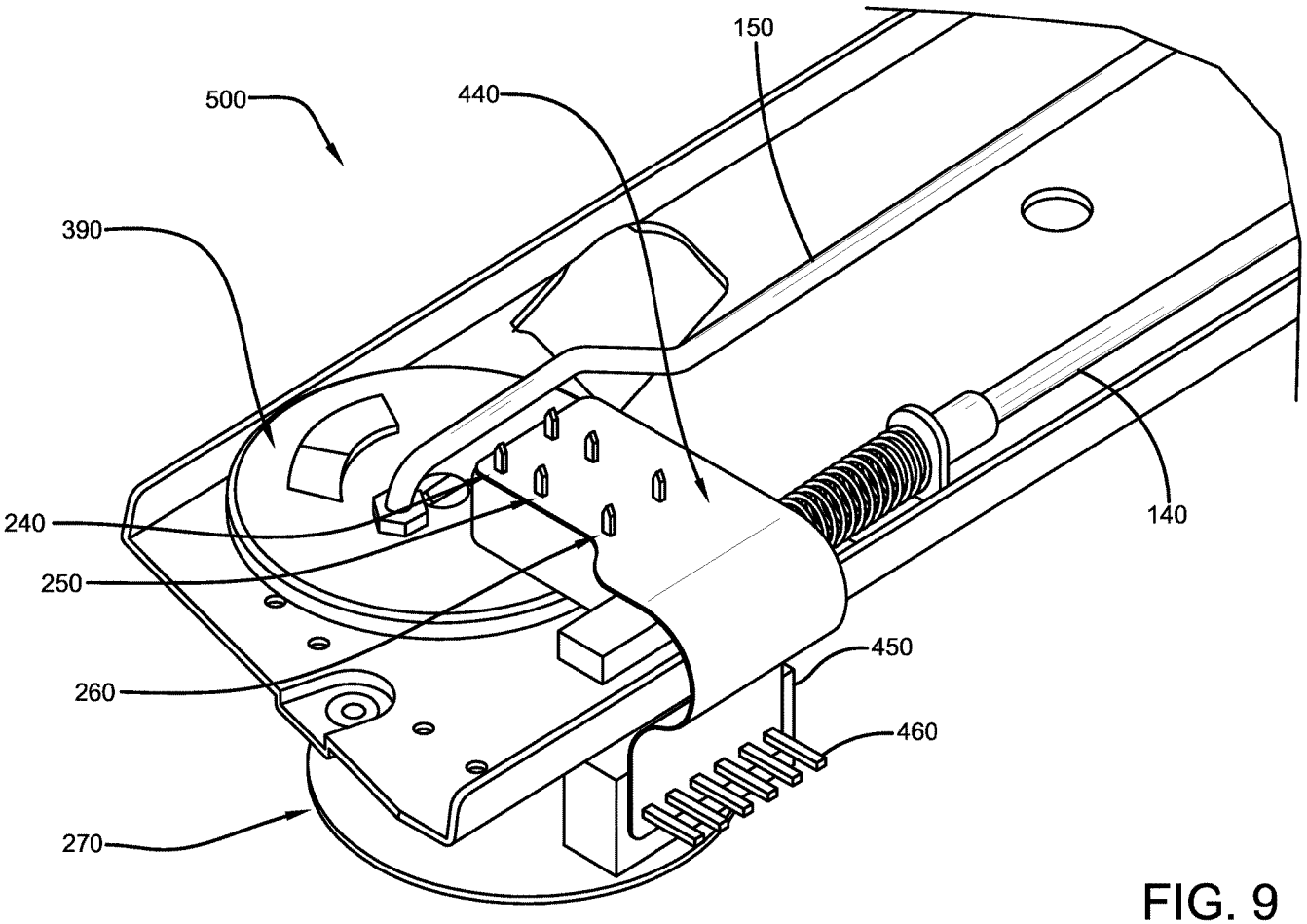
FIG. 9 is a close-up perspective view of a portion of the apparatus shown in FIG. 8.
Figure 10:
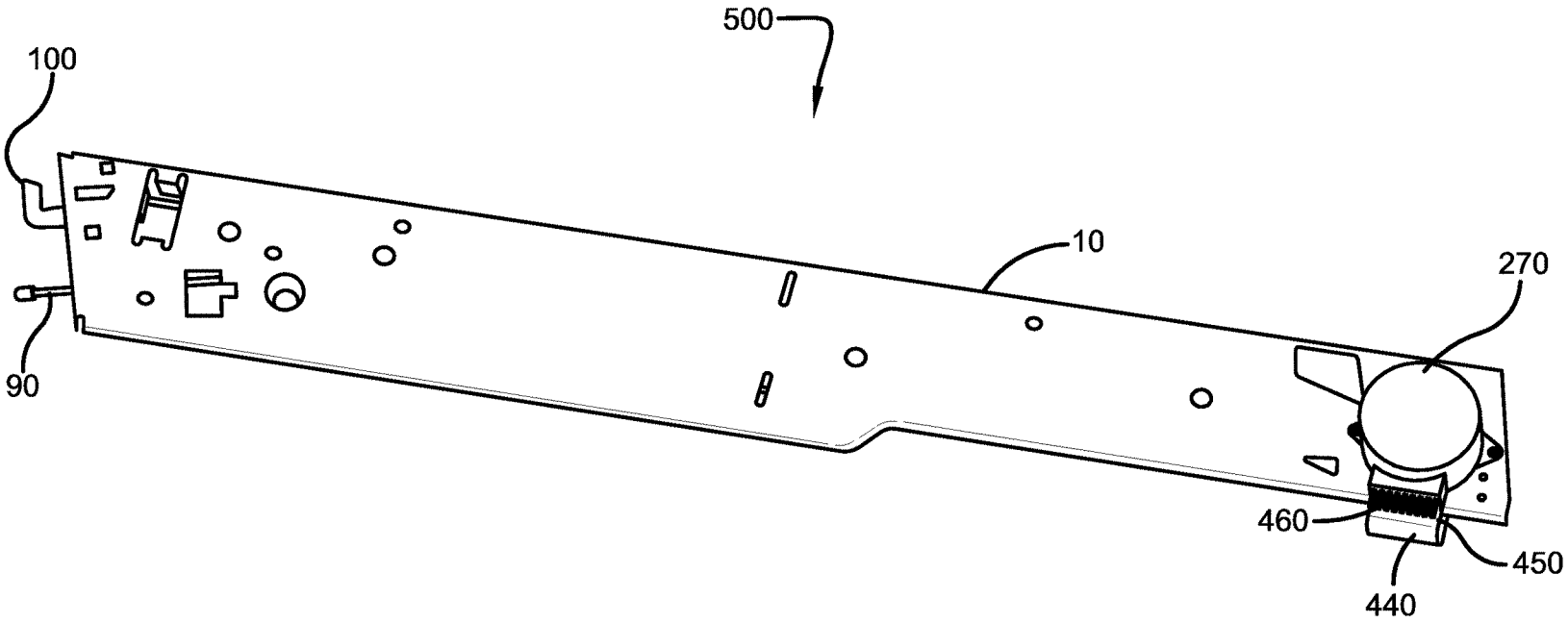
FIG. 10 is a perspective view of the bottom side of the apparatus shown in FIG. 8.
Figure 11:
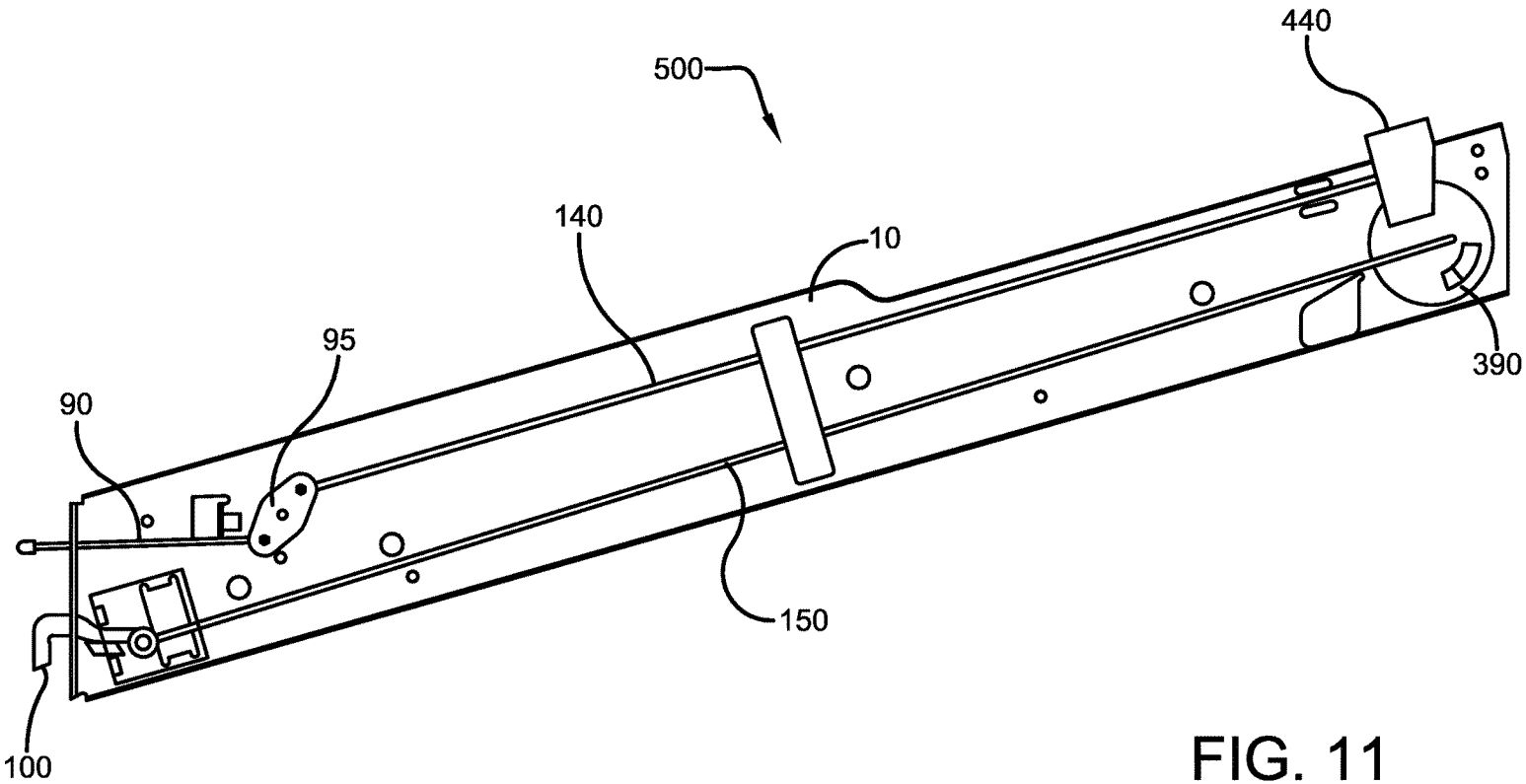
FIG. 11 is a perspective view of the top side of the apparatus shown in FIG. 8.
Figure 12:
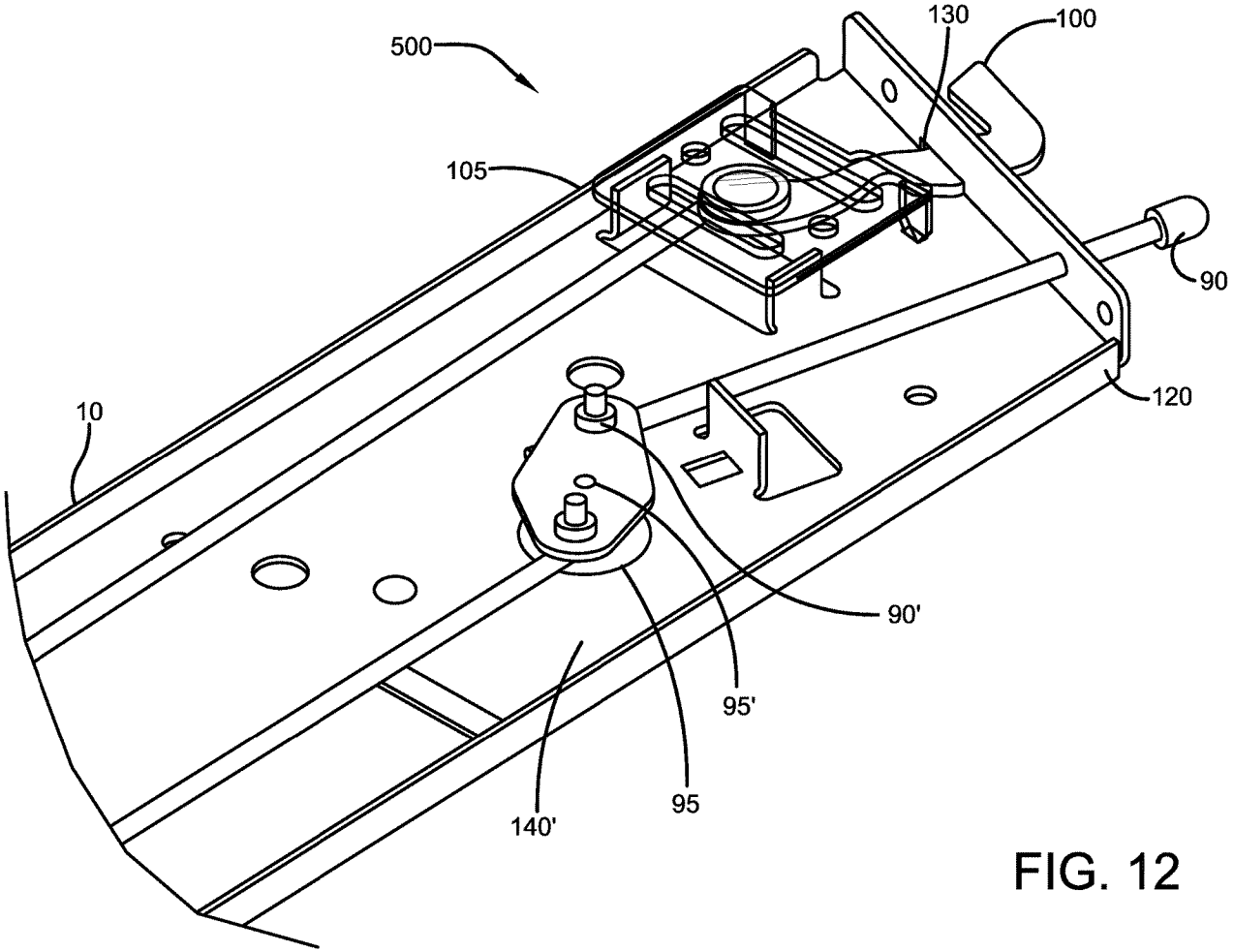
FIG. 12 is a close-up perspective view of a portion of the apparatus shown in FIG. 8.

In a second exemplary embodiment referred to as a front mount latch, shown in FIGS. 6 and FIGS. 7*a* and 7*b* (collectively and individually referred to herein as FIG. 7), assembly 200 may be constructed with a sheet metal chassis 210 which may be a generally flat part which may have flanges 220 and 230 on two sides providing rigidity, structural support and other benefits. FIGS. 6 and 7 shows a front face of chassis 210. Electrical switches 240, 250, and 260 and a motor 270 may be fixedly mounted at a proximal end 280 of chassis 210 and a door switch actuator 300 and a latch hook 310 may be movably mounted at an opposing distal end 290.

As shown in FIGS. 6 and 7, electrical switches 240, 250 and 260 and an electrical motor 270 (FIGS. 6 and 7) may be fixedly mounted to chassis 210 at the proximal end 280. An example of a motor which may be used within the present assembly is a synchronous motor in which rotation of the shaft is synchronized with the frequency of the current although any type of motor sufficient for use in such devices may be utilized. A door switch actuator 300 and a hook 310 may be movably mounted at the distal end 290 and both the door switch actuator 300 and hook 310 may extend outwardly from the distal end 290 through penetrations 320 and 330 in flange 220 as shown in FIGS. 6 and 7. The door switch actuator 300 and hook 310 may be secured on chassis 210 in a manner that enables them to move radially with respect to a pivotal axle 340 and 350 respectively. A biasing device 360 (e.g., a tension spring) attaches to a peg 370 on the door switch actuator 300 and connects to a latching portion 380 (e.g., a hook) on the frame or chassis 210 to hold the door switch actuator 300 in position. The biasing device 360 is secured to transfer radial force and supply radial motion to the door switch actuator 300 along pivotal axis 340. The latch hook 310 is secured for radial motion along pivotal axis 350. Radial force is transferred between motor 270 and hook 310 through a switch actuation cam 390 and lever 400 which connects the switch actuation cam 390 to the latch hook 310. A biasing device 410 (e.g., a tension spring) attaches to a latch hook slot 420 on the latch hook 310 and connects to a latching portion 430 (e.g., a hook) on the frame or chassis 210 to hold the latch hook 310 in position.

FIGS. 6 and 7 show that a flexible printed circuit 440 is mounted on the top portion of switches 240, 250 and 260. The flexible printed circuit 440 may be constructed of a material capable of undergoing a sufficient amount of torsional strain to connect several different components of the latching apparatus. As shown within FIGS. 6 and 7, the flexible printed circuit 440 wraps around the motor 270 and connects to a connector port 450 (e.g., on the face or any other portion of the connector port) which is integrated directly within the motor 270. The electrical connector pins 460 of the connector port 450 may extend into and penetrate through the flexible printed circuit 440 and into the motor 270 as is shown in FIGS. 6 and 7. Switches 240, 250 and 260 also may have electrical terminals 470 respectively, which may extend through the flexible printed circuit 440. The flexible printed circuit 440 may also connect passive electrical components such as fuses, capacitors, and resistors (not shown). Flexible printed circuits have at least one lamination layer of protective insulation material over the copper circuit paths. In certain embodiments, the flexible printed circuit may be further protected against transient electromagnetic fields present within the system by laminating metallic shielding materials over the flexible printed circuit.

FIGS. 6 and 7 show by arrow "B" that the door switch actuator 300 is able to move within penetration 320 by rotation of its distal end along pivotal axle 340. Biasing device 360 holds the door switch actuator 300 in a position in which the proximal end of the door actuator switch does not contact switches 240, 250 and 260. When a force is applied to the distal end of the door switch actuator 300 (e.g., a radial clockwise force), a corresponding opposing rotational force is applied to the biasing device 360 causing the biasing device 360 to extend. This causes the proximal end of the door switch actuator 300 to contact switches 240, 250 and 260 to complete the electrical circuit between the connector port 450, switches 240, 250 and 260, the flexible printed circuit 440 and the electrical motor. In certain embodiments, once the circuit is complete, a signal is sent to the electrical motor 270 to initiate activation of the switch actuation cam 390 (it is noted that in other embodiments, completion of the circuit may signal that the electrical motor 270 not to operate the switch actuation cam 390). The electrical motor then rotates the switch actuation cam 390 which causes lever 400 to move towards the distal end of the assembly 200. This,in turn, causes the latch hook 310 to move in a clockwise or counter-clockwise fashion within the penetration 330 to engage a door latching feature (not shown). Biasing device 410 engaged to a latching portion 430 (e.g., a hook) on the frame or chassis 210 assists in holding the latch hook 310 in a closed position within penetration 330. This feature enables the latch hook 310 to remain engaged to the door latching feature (not shown), thereby securing the latch hook 310 to the door latch (not shown As mentioned above, this locking mechanism begins with the proximal end of the door switch actuator 300 rotating in a clockwise or counter-clockwise manner to a first position to contact switches 240, 250 and 260. This clockwise or counter-clockwise rotation of the proximal end of the door switch actuator 300 may be the result of an inner surface of a door contacting the distal end of the door switch actuator 300 which causes the distal end of the door switch actuator 300 to correspondingly rotate in a clockwise or counter-clockwise manner. Once the inner surface of the door contacts the distal end of the door switch actuator 300 and the proximal end of the door switch actuator 300 contacts at least one of switches 240, 250 and 260, a signal is sent by the switches to the electrical motor 270 indicating that the door is closed and that it is now safe for the motor to initiate the locking mechanism through operation of the latch hook 310. To release the latch hook 310, a signal is sent to the motor that a certain event or period of time is complete (e.g., that an oven or appliance cleaning cycle is complete) indicating that the latch mechanism may be released. The motor 270 will then cause the switch actuation cam 390 to rotate in a direction opposite to the closing mechanism to a second position which will cause the lever 400 to move laterally towards the proximal end of the assembly 200 and the distal end of the latch hook 310 to move or rotate clockwise or counter-clockwise within penetration 330 to a second position.

In an alternative embodiment, the proximal end of the door switch actuator 300 may be rotated in a clockwise or counter-clockwise manner so as not to contact at least one of switches 240, 250 and 260. This will result in an electrical open, which may be used to signal that the door (not shown) is secured and that it is acceptable to energize motor 270 to engage the latching mechanism. In such embodiments, the inner surface of the door causes the distal end of the door switch actuator 300 to rotate in a clockwise or counter-clockwise position within penetration 320 and the proximal end of the door switch actuator 300 to correspondingly rotate in a clockwise or counters clockwise manner to a position away from the switches 240, 250 and 260. Biasing device 360 engaged to a latching portion 380 (e.g., a hook) on the frame or chassis 210 assists in holding the door switch actuator 300 in the appropriate position within penetration 320. This feature enables the door switch actuator 300 to remain engaged with a door receiving portion (not shown), thereby securing the door switch actuator 300 to the door receiving portion (not shown).

It should be understood that the terms "clockwise" and "counter-clockwise" may refer to the door switch actuator and latch hook moving to the left or to the right when one stands in front of an appliance having the installed latching apparatus and directly faces penetrations 320 and 330. It should be further understood that the configuration of the latching apparatus, the orientation of the components within the latching apparatus and the orientation of the latching apparatus within the appliance may vary in different embodiments and that the directional operation of the various component parts such as the door switch actuator and latch hook may vary accordingly.

As in other embodiments, the sequence of events may be triggered when the door (e.g., an oven or other appliance door) is closed and a console button is depressed to generate an electrical signal for high temperature cleaning. This signal is transmitted through pins 460 of connector port 470 via a plug on a wire harness (not shown) and then through flexible printed circuit 440 to energize motor 270. The switches 240, 250 and 260 function as a gateway which determines whether or not power from the connector port 450 is permitted to energize the motor 270. Thus, electrical switches 240, 250 and 260, the flexible printed circuit 440, connector port 450, electrical connector pins 460 and the electrical motor 270 are electrically connected to each other through the flexible printed circuit 440 at a single point power connection. The single point power connection is connected directly to the motor 270 and is used to transmit electrical power to directly to the motor while electrical switches 240, 250 and 260 control the transmission of electrical power to the motor 270. The electrical connection is established by connecting a plug to a receptacle within the connector port 450. In certain cases, this embodiment may be referred to as a front mount oven latch with a single power point connector. It should be understood that although the single point power connection referred to throughout this disclosure is connected to certain mechanical or latching mechanisms which are described in detail herein, the single point power connection is intended to work with any type of mechanical or latching mechanism within the art.

In certain embodiments, the connector pins are oriented within the receptacle in an asymmetrical manner to require a polarized connection between the plug and the connector port which requires the plug to be oriented to a specific side to engage the connector port. The receptacle of the connector port may include a first horizontal row and a second horizontal row of connector pins. The first horizontal row and the second horizontal row of connector pins may form an asymmetrical pattern of connector pins within the receptacle. In certain embodiments, the receptacle of the connector port may include six (6) connector pins within the first horizontal row and six (6) connector pins within the second horizontal row although any number of connector pins suitable for use within the connector port may be utilized.

In a further embodiment, the single point power connector described with respect to FIGS. 6 and 7 may be incorporated into a long bar oven latch or a similar type latching device described within FIGS. 1 through 4. An example of such an assembly is provided within FIGS. 8 through 12. In this embodiment, mechanical operation of the assembly will occur in a manner similar to that described with respect to FIGS. 1 and 4 whereas operation of the electrical components and motor will occur in a manner similar to that described with respect to FIGS. 6 and 7. In this embodiment, the actuator rod 140 will trigger operation of the switches 240, 250 and 260 and that the operation of the cam 390 will trigger operational movement of the actuator rod 150. In an alternative embodiment, latching apparatus will not have an actuator rod 140 or rotational link 95 and the push rod 90 will extend through the length of the chassis to trigger operation of the switches 240, 250 and 260. In this embodiment, closed circuit resulting from the push rod 90 contacting the switch or switches will signal the operation of the motor 270.

Assemblies 5, 200 and 500 are constructed in a manner that improves assembly speed in production by reducing the amount of labor and the number of parts that are required and thereby avoiding assembly errors (e.g., wire assembly and mechanical assembly errors) which are common in the art. Assemblies 5, 200 and 500 also provide simplified operation as compared with current prior art devices in use. For assembly 5 the transmission of transient electrical signals are prevented from affecting the electrical circuit on board 160.

Additionally, assemblies 200 and 500 provide the following benefits. First, the single point power connection reduces or eliminates wire connection errors. In this case, it is not possible for printed circuit paths to be connected incorrectly. Therefore, assembly workers and service technicians will not have an opportunity to misconnect the wiring. Second, assemblies 200 and 500 will reduce assembly time in oven manufacturing since the mating wire harness will only have one connector that plugs into the latch. Third, the oven latch connection will install easier and reduce repetitive motion injuries for assembly workers. This is due at least in part to the single point connector using normal hand and finger motion to install the connector. This is in contrast to male and female wire terminals which are typically installed with needle nose pliers and use abnormal hand and finger manipulations. Such hand and finger manipulations are known to cause carpal tunnel injuries and expose workers to sharp edges of surrounding structures. Fourth, the flexible printed circuit improves wire connection integrity by incorporating robust manufacturing processes of wave soldering the switch and motor terminals to the flexible circuit paths. This eliminates the use of mechanical crimping methods which are typically used to connect terminals to wires. Fifth, the single point power connection is built into the motor terminal body. This is a relatively strong and solid connection structure compared to other components which use circuit board mounted connectors. Circuit board mounted connectors lack sufficient structure for withstanding the normal insertion forces assembly workers apply when making similar connections. Sixth, single point power connections can be incorporated into front mount oven latches which are mounted above the oven door or can be incorporated into long-bar type latches that extend from front to back directly above the oven compartment. Seventh, the single point power connection feature can be manufactured in many orientations. For example, the connection terminals can be oriented to one side or the other or at any angle between. The terminal can also be oriented up or down. This flexibility provides the oven or appliance manufacturer with many options for best fit, function, wire routing or assembly. Further, the single point power connection can incorporate high temperate rated materials. This may be useful for oven or other appliance designers who want to maximize oven space by reducing the space required for other components (typically lower temperature materials require considerable space for cooling air to keep components below operational limits). Finally, the single point power connection may have a wire connector locking feature that will secure the mating wire connector to the assembly. This may come in the form of a molded-in snap feature or a separate component that will hold the wire harness connector in place.

While the electro-mechanical assembly has been described above in connection with various illustrative embodiments, it is to be understood that other similar embodiments may be used or modifications and additions may be made to the described embodiments for performing the same function disclosed herein without deviating therefrom. Further, all embodiments disclosed are not necessarily in the alternative, as various embodiments may be combined or subtracted to provide the desired characteristics. Variations can be made by one having ordinary skill in the art without departing from the spirit and scope hereof. Therefore, the electro-mechanical assembly should not be limited to any single embodiment, but rather construed in breadth and scope in accordance with the recitations of the appended claims.

What is claimed is:

1. A latching apparatus suitable for use with an appliance door having a proximal end and a distal end and movable between a non-latching state and a latching state, the latching apparatus comprising:

a chassis which houses at least one electrical switch, an electrical motor driving a cam, a door switch actuator having a proximal end and a distal end, a latch hook, and a flexible printed circuit;

wherein when the latching apparatus is in the non-latching state:

a. the proximal end of the door switch actuator is in a first position with respect to the electrical switch and the distal end of the door switch actuator is in corresponding first position wherein the position of proximal end of the door switch actuator with respect to the electrical switch, results in an open or closed electrical circuit with the electrical switch, and b. the latch hook is in a non-latching position wherein the proximal end of the latch hook is engaged with the cam, the cam being in contact with but not activated by the switch, and wherein when the latching apparatus is in the latching state:

a. the proximal end of the door switch actuator is in a second position with respect to the electrical connector and the distal end of the door switch actuator is in a corresponding second position wherein:

b. the door of the appliance will engage the door switch actuator, so as to move the door switch actuator into position, wherein movement of the door switch actuator causes the proximal end of the door switch actuator to contact or not contact the at least one electrical switch to close a circuit between the switch and the motor and c. the latch hook is in a latching position wherein the proximal end of the latch hook, engaged with the cam, is activated by the electrical switch and the motor, wherein the motor is activated by the closed circuit between electrical switch and the motor and wherein the activated motor causes the cam and the latch hook to move to the latching position, and wherein the electrical switch and the electrical motor are electrically connected to each other through the flexible printed circuit which connects the electrical switch to a single point power connector comprising a connector port and electrical connector pins, wherein the flexible printed circuit is assembled, having one end connected to the connector port, wrapping around the electrical motor, causing the flexible printed circuit to be subject to a torsional strain, and having an opposing end connected to the electrical switch, wherein the connector port and electrical connector pins receive a plug on a wire harness which provides electrical power to the motor.

2. The latching apparatus of claim 1, wherein the electrical connector pins of the connector port extend into and penetrate through the flexible printed circuit.

3. The latching apparatus of claim 2, wherein the single power point connector is integrated into the motor.

4. The latching apparatus of claim 3, wherein the latching apparatus comprises at least three electrical switches.

5. The latching apparatus of claim 4, wherein at least one electrical switch receives a signal from a control panel indicating that a user has selected a self-clean function in the control panel and a controller within the appliance activates the latching apparatus to engage the latch hook to the appliance door.

6. The latching apparatus of claim 5, wherein the electrical circuit between the switches and the motor is completed upon closing of the door.

7. The latching apparatus of claim 6, wherein the motor is a synchronous motor and the cam is a switch actuation eccentric cam.

8. The latching apparatus of claim 7, wherein a lever connects the switch actuation eccentric cam to a pivotal axle on the latch hook.

9. The latching apparatus of claim 8, wherein the distal end of the latch hook engages a slot so that as the switch actuation eccentric cam rotates, the latch hook may both move along the slot between a latching position and a non-latching position.

10. The latching apparatus of claim 9, wherein a first biasing device engages the door switch actuator to a first latching portion on the chassis.

11. The latching apparatus of claim 10, wherein a second biasing device engages the latch hook to a second latching portion on the chassis.

12. A method of assembling a latching apparatus within an appliance comprising:

providing an appliance comprising a door and a door latch;

providing a latching apparatus comprising a chassis which houses at least one electrical switch, an electrical motor driving a cam, a door switch actuator having a proximal end and a distal end, a latch hook, and a flexible printed circuit;

wherein when the latching apparatus is in the non-latching state:

a. the proximal end of the door switch actuator is in a first position with respect to the electrical switch and the distal end of the door switch actuator is in a corresponding first position, wherein the position of proximal end of the door switch actuator with respect to the electrical switch, results in an open or closed electrical circuit with the electrical switch, and b. the latch hook is in a non-latching position wherein the proximal end of the latch hook is engaged with the cam, the cam being in contact with but not activated by the switch, and wherein when the latching apparatus is in the latching state:

a. the proximal end of the door switch actuator is in a second contact position with respect to the electrical switch and the distal end of the door switch actuator is in an corresponding second position wherein:

b. the door of the apparatus will engage the door switch actuator, so as to move the door switch actuator into position, wherein movement of the door switch actuator causes the proximal end of the door switch actuator to a second position with respect to the at least one electrical switch to close a circuit between the switch and the motor and c. the latch hook is in a latching position wherein the proximal end of the latch hook, engaged with the eccentric cam, is activated by the electrical switch and the motor, wherein the motor is activated by the closed circuit between electrical switch and the motor and wherein the activated motor causes the cam and the latch hook to move to the latching position, and wherein the electrical switch and the electrical motor are electrically connected to each other through a flexible printed circuit which connects the electrical switch to a single point power connector comprising a connector port and electrical connector pins, wherein the flexible printed circuit is assembled, having one end connected to the connector port, wrapping around the electrical motor, causing the flexible printed circuit to be subject to a torsional strain, and having an opposing end connected to the electrical switch, wherein the connector port and electrical connector pins receive a plug on a wire harness which provides electrical power to the motor, wherein the electrical connector pins of the connector port extend into and penetrate through the flexible printed circuit, inserting the chassis containing the component parts of the latching assembly within the appliance;

orienting the chassis and latching assembly within the appliance in a manner which allows the hook to engage the door latch;

mechanically connecting the latching assembly to the appliance by connecting the chassis to the appliance; and electrically connecting the latching assembly to the appliance by connecting the plug to the connector port through the single point power connection.

* * * * *